US005919029A

United States Patent [19]

Van Nostrand et al.

[11] Patent Number: 5,919,029

[45] Date of Patent: Jul. 6, 1999

[54] NOISE ABSORPTION SYSTEM HAVING ACTIVE ACOUSTIC LINER

[75] Inventors: William C. Van Nostrand, Ronkonkoma; Charles A. Parente, Oyster Bay; Noe Arcas, Plainview, all of N.Y.

[73] Assignee: Northrop Grumman Corporation, Los Angeles, Calif.

[21] Appl. No.: 08/751,544

[22] Filed: Nov. 15, 1996

[51] Int. Cl.[6] ..... F01D 25/04

[52] U.S. Cl. ..... 415/119; 181/206; 244/1 N; 381/71

[58] Field of Search ..... 415/119, 118; 60/725; 181/206; 381/71; 244/1 N

[56] References Cited

U.S. PATENT DOCUMENTS

| | | | |
|---|---|---|---|
| 4,044,203 | 8/1977 | Swinbanks | 181/206 |
| 4,715,559 | 12/1987 | Fuller . | |
| 4,815,139 | 3/1989 | Eriksson et al. | 381/71 |
| 5,018,203 | 5/1991 | Saywers et al. . | |
| 5,119,427 | 6/1992 | Hersh et al. . | |
| 5,315,661 | 5/1994 | Grossman et al. | 381/71 |
| 5,341,857 | 8/1994 | Bravo . | |
| 5,355,417 | 10/1994 | Burdisso et al. . | |
| 5,370,340 | 12/1994 | Pla . | |
| 5,382,134 | 1/1995 | Pla et al. . | |
| 5,423,658 | 6/1995 | Pla et al. | 181/206 |
| 5,478,199 | 12/1995 | Gliebe | 415/119 |
| 5,498,127 | 3/1996 | Kraft et al. | 244/1 |
| 5,558,298 | 9/1996 | Pla et al. | 244/1 |
| 5,590,849 | 1/1997 | Pla | 244/1 |
| 5,618,010 | 4/1997 | Pla et al. | 415/119 |
| 5,702,230 | 12/1997 | Kraft et al. | 415/119 |
| 5,732,547 | 3/1998 | Olsen et al. | 415/119 |

FOREIGN PATENT DOCUMENTS 0 817 164 1/1998 France .

*Primary Examiner*—F. Daniel Lopez
*Assistant Examiner*—Richard Woo
*Attorney, Agent, or Firm*—Terry J. Anderson; Karl J. Hoch, Jr.

[57] ABSTRACT

The present invention is embodied in an aircraft engine noise absorption system having a resonator cavity for absorbing incident noise except for a residue noise signal having a predominant frequency, the system comprising an actuator providing an actuator acoustic signal, a noise sensor for sensing the predominant frequency, and a controller for setting the actuator acoustic signal to the predominant frequency and varying one of a phase and an amplitude of the actuator acoustic signal to decrease the residue noise signal.

26 Claims, 4 Drawing Sheets

NOISE ABSORPTION SYSTEM HAVING ACTIVE ACOUSTIC LINER

BACKGROUND OF THE INVENTION

1. Technical Field

This invention relates to an active noise absorption system to reduce aircraft engine noise. Specifically, the invention relates to a system having an active acoustic liner on interior engine surfaces and related control elements that absorb noise generated by the fans and turbines of modern aircraft engines.

2. Background Art

There is a great need to reduce the noise levels generated by commercial and military aircraft at ground levels near runways. One current solution is to use passive acoustic liners with fixed geometry in the engine inlet surfaces. Such acoustic liners consist of a honeycomb core that is covered by a porous face sheet. Each of the cells of the honeycomb acts as a Helmholtz resonator to absorb acoustic energy. The cells will absorb a maximum amount of incoming acoustic energy only at the resonant frequency of the cell, which absorption decreases as the incoming acoustic energy changes from the resonant frequency. The size and depth of the honeycomb cells and the porosity of the face sheet effect the noise absorption characteristics of the liner.

This type of passive honeycomb liner will not, however, meet the quickly-increasing noise requirements imposed on such engines by local authorities and the Federal Aviation Administration. In fact, many aircraft will be forced out of service prior to their planned service life if engine noise levels cannot be reduced in an efficient and economic manner. For example, some noise reduction methods such as hush kits provide effective noise level reduction, but are expensive and add weight to the aircraft. The added weight degrades engine performance and reduces fuel economy.

Actively controlling the conditions inside the honeycomb cell provides many advantages. The structure of a passive acoustic liner are usually designed to optimize noise absorption in a narrow frequency range of their resonant frequency, such as a frequency related to the angular velocity of the engine and the number of turbine blades. A typical target frequency of noise to be absorbed is approximately 1,000 Hz. However, the predominant frequency of noise to be absorbed changes with particular flight conditions of the aircraft, for example during take off or airport approach. By controlling the conditions inside the cell, however, the optimum noise absorption performance can be maintained over a wide range of flight conditions and frequencies.

One problem with active acoustic liners that have been proposed is that current designs have not provided a practical solution. For example, one approach has been to generate cancelling noise fields generated with acoustical inputs, i.e., out of phase signals with equal amplitudes. One implementation of this approach has been to place speakers behind or in the cells of the acoustic liner. The added size and weight of such systems, however, has made them impractical. Further, such systems are not robust and consume substantial power. In addition, if a speaker is required for each honeycomb cell, numerous speakers would be required adding to the expense and reliability of the system.

Thus, it is one object of the invention to provide an active acoustic liner that is light in weight and small in size. These objects will minimize the effects on engine and aircraft performance of the system.

Another object of the invention is to provide an active acoustic liner that is rugged and able to withstand the severe shock, vibration and temperature present in the engine inlets.

Another object of the invention is to provide an active acoustic liner with few active components to increase its time between failures and simplify maintenance of the liner system.

Another object of the invention is to provide an active acoustic liner system that can be used with existing passive liner designs. This object will reduce implementation costs and qualification time.

SUMMARY OF THE INVENTION

The present invention is embodied in an aircraft engine noise absorption system having a resonator cavity for absorbing incident noise except for a residue noise signal having a predominant frequency, the system comprising an actuator providing an actuator acoustic signal, a noise sensor for sensing the predominant frequency, and a control means for setting the actuator acoustic signal to the predominant frequency and varying one of a phase and an amplitude of the actuator acoustic signal to decrease the residue noise signal.

DETAILED DESCRIPTION OF THE PREFERRED EMBODIMENT

Figure 1:
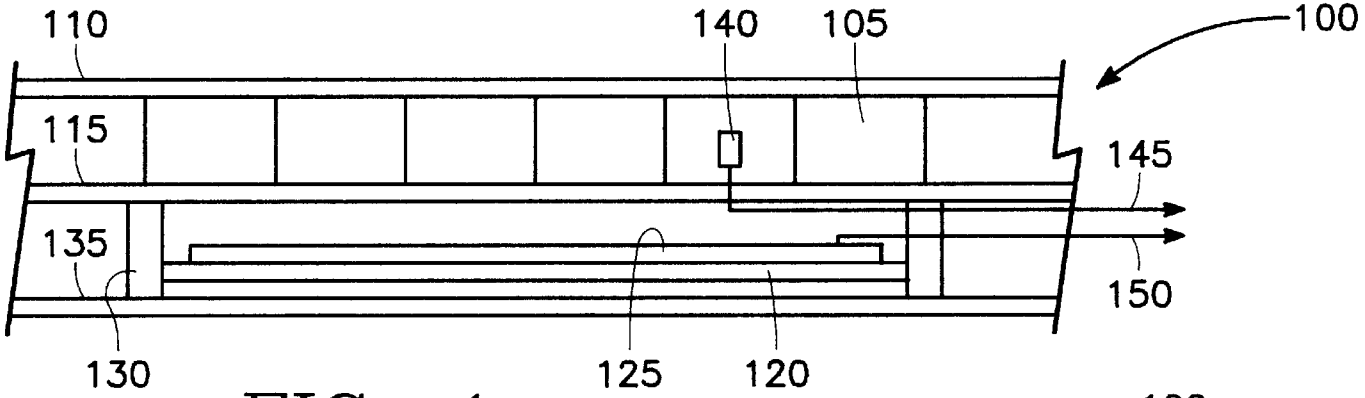
FIG. 1 is a side view of an active acoustic transducer according to the invention mounted beneath a passive acoustic liner of honeycomb material.

As shown in FIG. 1, an active acoustic transducer 100 of the invention is affixed to the back of a conventional honeycomb acoustic liner. The honeycomb structure is composed of a series of hexagonal cells 105 sandwiched between a porous face sheet 110 and another porous sheet known as a septum 115.

The transducer 100 is composed of a piezoresonator 120 on which is mounted a piezoelectric ("PZT") actuator 125. The piezoresonator 120 is a sheet of metal such as brass or aluminum approximately 0.010 inches thick. The PZT actuator is made of conventional PZT materials and is also approximately 0.010 inches thick. The piezoresonator 120 is supported by columns 130 that are conventionally used to support the honeycomb structure from the outer skin 135 of the engine. The skin 135 is typically made of aluminum and may have a thickness of approximately 0.050 inches.

An acoustical sensor 140, such as a microphone, is mounted inside one of the cells 105 over which the transducer 100 is placed. Leads 145 and 150 connect the sensor 140 and the piezoactuator 125, respectfully, to sensing and control circuits described later.

Figure 2:
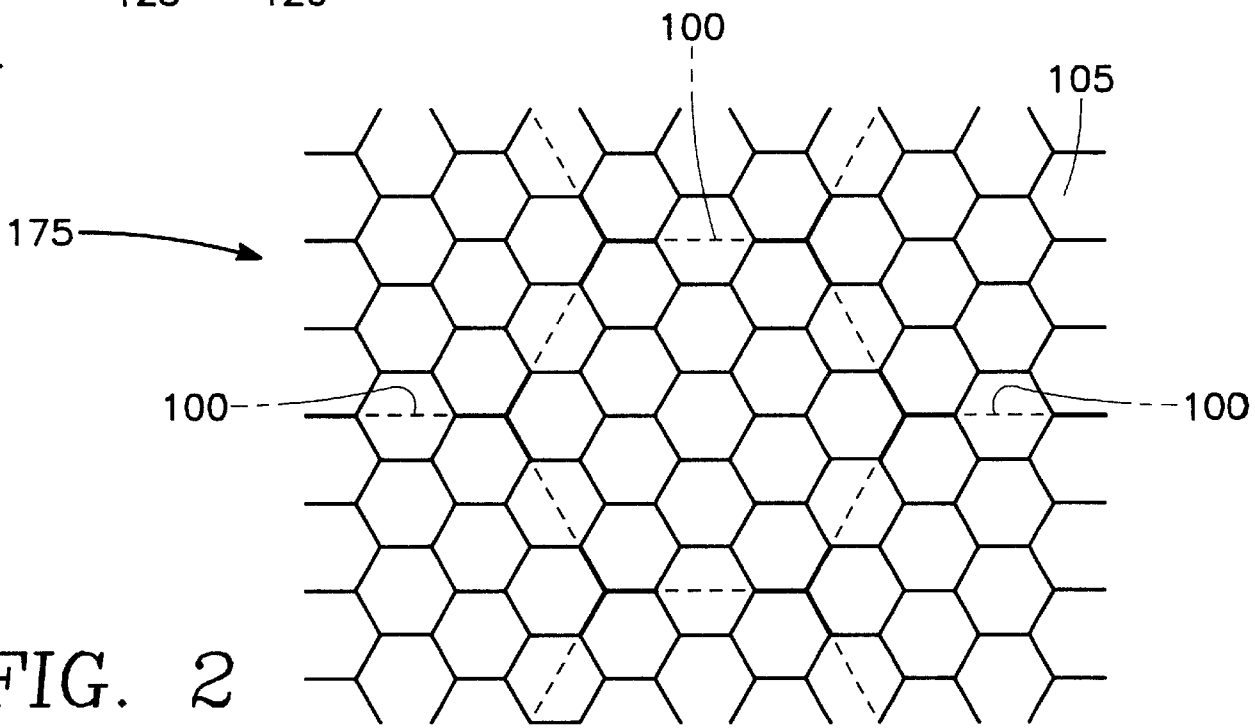
FIG. 2 is a plan view of the elements of FIG. 1.

A plan view of the transducer 100 in FIG. 2 illustrates the novel method of placement of the actuator with respect to the cells 105. Each transducer 100 is placed under several cells 105 and the transducers 100 have edges that abut edges of other transducers 100, forming a transducer array 175. The transducers 100 may have the same shape as the cells 105, i.e., hexagonal, as shown in FIG. 2, or other shapes such as triangles, squares or rectangles.

Figure 3:
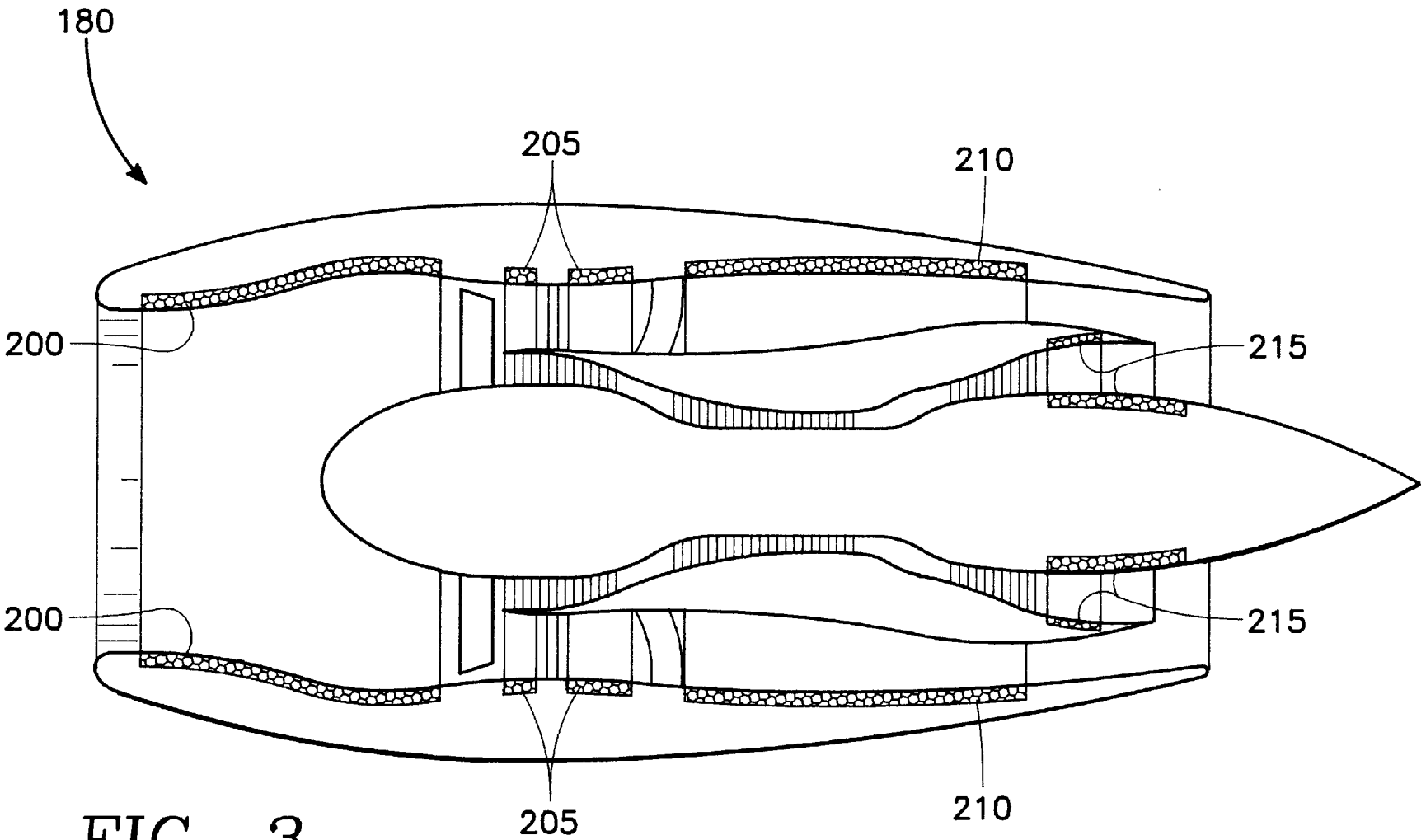
FIG. 3 is a cross section side view of an aircraft engine showing placement of active acoustic liners of the invention.

The transducer arrays 175 are placed behind various noise generating surfaces of an engine 180 as shown in FIG. 3. For example, arrays 175 (shown in FIG. 2) may be placed at inlet surfaces 200, fan casing surfaces 205, fan exhaust duct surfaces 210 and turbine exhaust duct surfaces 215.

Figure 4:
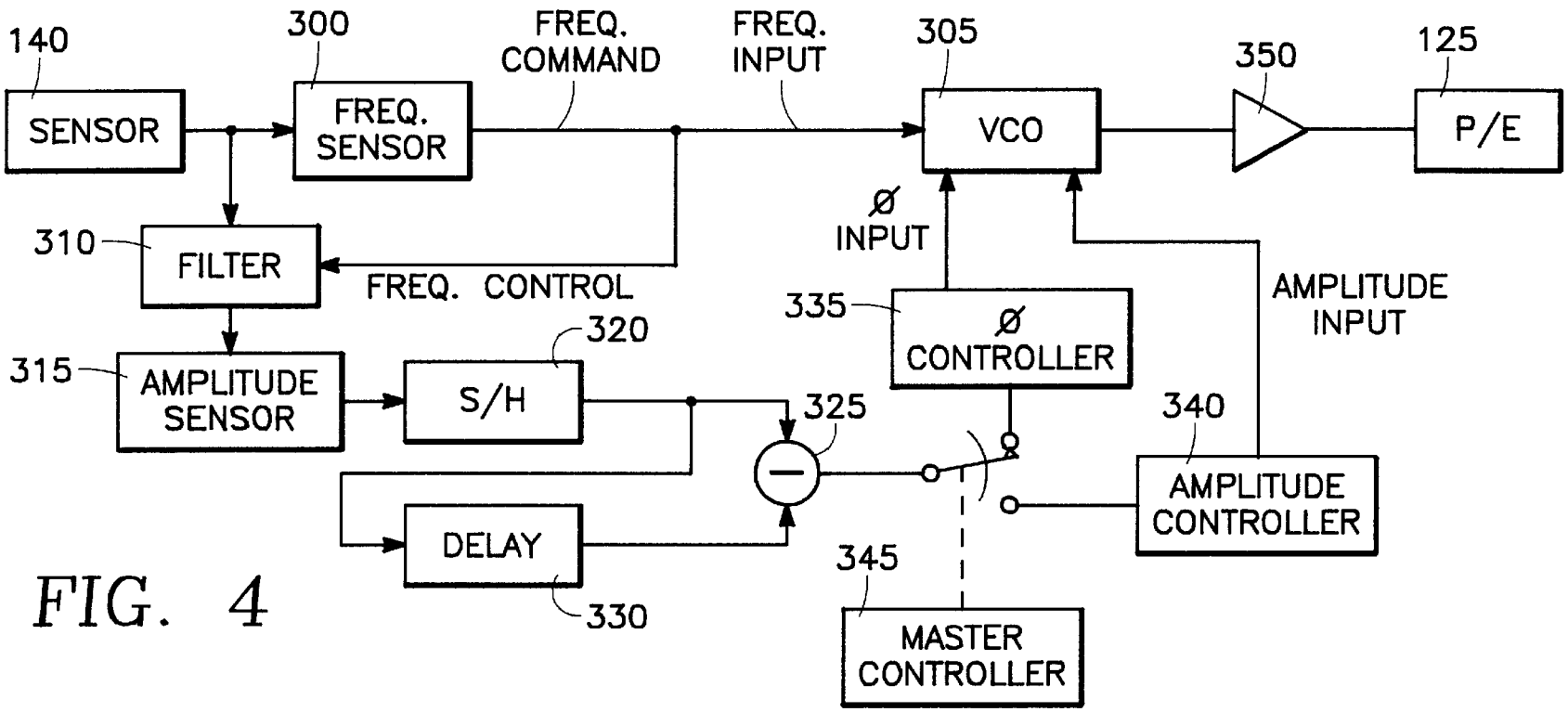
FIG. 4 is a schematic block diagram of circuit components controlling an active acoustic transducer of the invention.

The transducers 100 of the invention can be controlled by any number of control systems known to those skilled in the art, one of which is illustrated in FIG. 4. A signal from the sensor 140 is transmitted to a frequency sensor 300 to identify a center frequency of a predominant component of unabsorbed noise, for example f. The output of the frequency sensor 300 sets the frequency of an oscillator 305 to the same frequency f, for example by providing a frequency input for a voltage controlled oscillator. In addition, the frequency sensor 300 tunes a filter 310 with a frequency control signal, which filter passes only the signal from the sensor 140 at the frequency f.

The output of the filter 310 is transmitted to an amplitude sensor 315 that determines the amplitude of the acoustic signal at the frequency f. This amplitude signal is transmitted to a sample and hold circuit 320 the output of which is sent to a subtractor 325 and to a delay circuit 330. The subtractor compares the amplitude of a signal having frequency f at a time $t_1$ to its amplitude at a selected delay time $t_2$. The output of the subtractor 325 represents the difference in the amplitude of the undesired signal between $t_1$ and $t_2$, and indicates whether the undesired noise is being increased or decreased.

The output of the subtractor 325 is switched between a phase controller 335 and an amplitude controller 340 by means of a master controller 345. The phase controller 335 and the amplitude controller 340 increase and decrease the phase and amplitude, respectively of the signal generated by the transducer 100 (shown in FIG. 1). Thus, the phase controller 335 and the amplitude controller 340 provide a phase input signal and amplitude input signal, respectively, to the oscillator 305. The acoustic signal from the oscillator 305 is amplified by a power amplifier 350 the output of which excites the PZT actuator 125.

Figure 5:
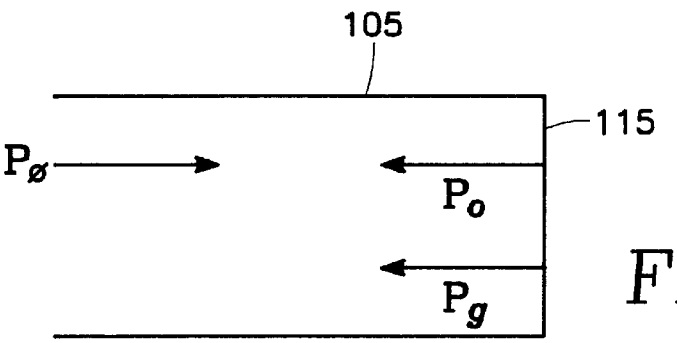
FIG. 5 is a cross section side view of a resonator cavity illustrating a noise absorbing signal generated by the invention.

The operation of the noise reduction system can be understood by reference to a diagram of the time varying acoustic waves inside one cell of the invention, as shown in FIG. 5. An undesired acoustic wave having a pressure amplitude $P_o$ and a phase and frequency is generated by vibration of an engine component, such as the fans or turbines, and is incident on the cell 105. This wave is incident on the septum 115 and reflected as a wave having the same amplitude $P_o$. The transducer 100 (shown in FIG. 1) also generates an acoustic wave having the same frequency as the incident wave $P_o$, but having a different amplitude $P_g$ and shifted in phase by an angle $\rho$.

Figure 6:
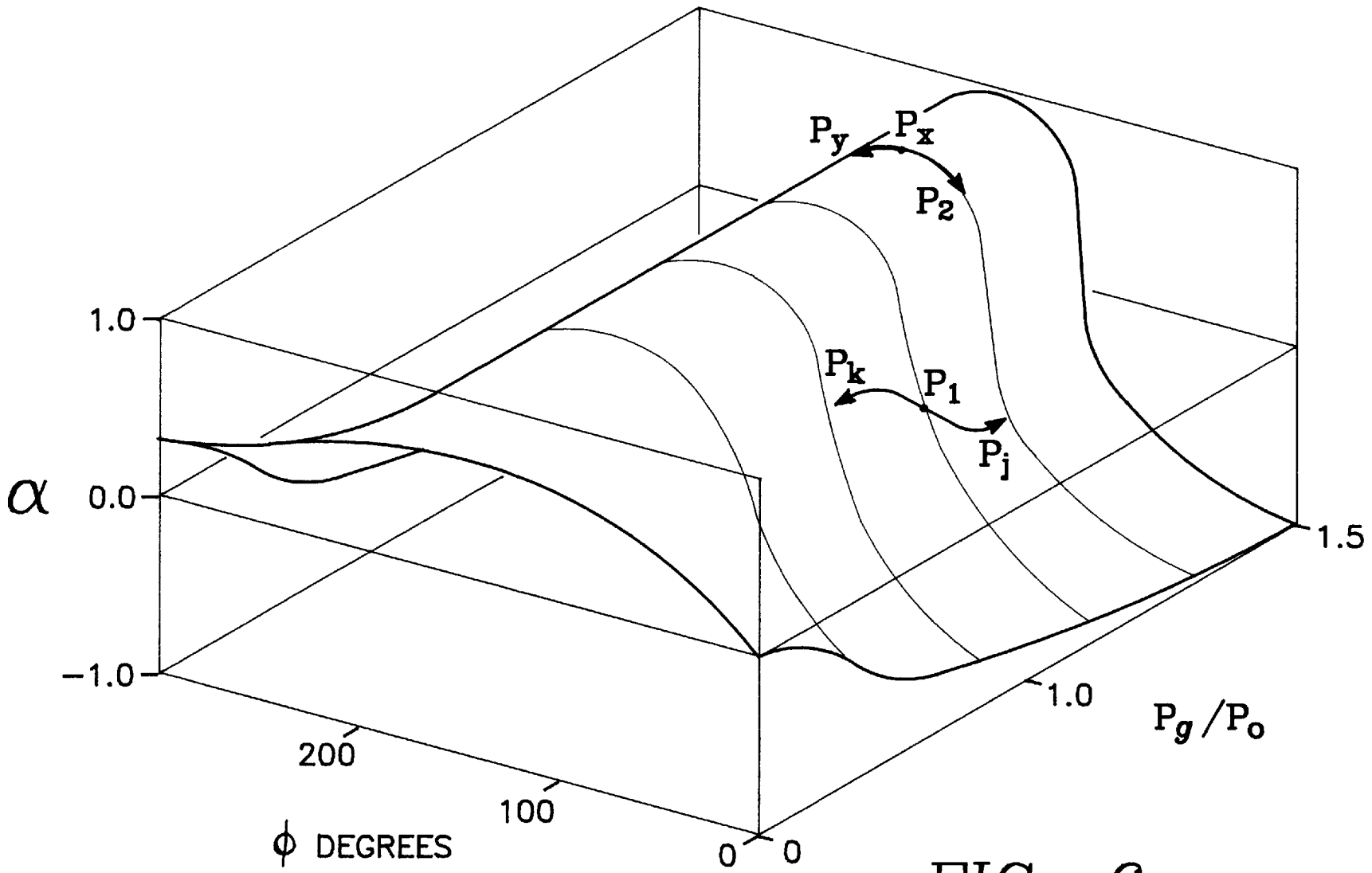
FIG. 6 is a three dimensional graph illustrating a relationship between a ratio of incident pressure to generated pressure, a phase angle of the noise absorbing signal and an absorption provided by a system of the invention at a fixed frequency of incident noise and depth of resonator cavity.

Using conventional one dimensional acoustic theory, a theoretical model of the absorption of this system can be derived, the results of which are shown in FIG. 6. The absorption $\alpha$ of the system is a function of the ratio of $P_g$ to $P_o$ and $\rho$ for a given cell depth d and wave frequency f that is desired to be absorbed. The model is useful to understand the general relationship between the operating parameters, but is limited by geometric approximations of the cell and engine structure. Thus, adjusting the amplitude $P_g$ and phase $\rho$ of the generated wave to achieve optimum absorption is accomplished empirically by the system of the invention.

For example, if the transducer 100 (shown in FIG. 1) is excited to generate a wave having an amplitude $P_g$ approximately equal to $P_o$ and having a phase shift of approximately 100 degrees, the generated wave may be represented by a point $P_i$ in FIG. 6, which generated signal would have an absorption $\alpha$ of approximately 0 in the cell defined in FIG. 6. As illustrated in FIG. 4, the master controller 345 initially selects one of the amplitude controller 340 or phase controller 335 to control the oscillator 305. If the amplitude controller 340 is selected, the amplitude of $P_i$ is, for example, increased to a signal $P_j$ (shown in FIG. 6), and the amplitude of the undesired signal at frequency f received by the sensor 140 is measured by the amplitude sensor 315. If the output of the subtractor 325 indicates an increase in the amplitude of the undesired signal (i.e., a decrease in $\alpha$), the amplitude controller 340 decreases the amplitude of the generated signal to a signal $P_k$. The amplitude of the generated signal is varied in this manner until the undesired signal amplitude is minimized at a given phase angle $\rho$.

The phase angle $\rho$ may be varied in a similar manner to minimize the undesired signal amplitude. For example, if the ratio of $P_g$ to $P_o$ is approximately 1.25 and the phase shift $\rho$ is approximately 200 degrees, the signal generated by the transducer 100 (shown in FIG. 1) may be represented by a point $P_x$ in FIG. 6, which generated signal would have an absorption $\alpha$ of approximately 0.8 in the cell defined in FIG. 6. Again as illustrated in FIG. 4, the master controller 345 would select one of the amplitude controller 340 or phase controller 335 to control the oscillator 305. If the phase controller 335 were selected, the phase angle $\rho$ would be increased to a new value represented by point $P_y$ (shown in FIG. 6) and the amplitude of the undesired signal of frequency f would be measured by the amplitude sensor 315 and compared by the subtractor 325 to the amplitude prior to the change in $\rho$. In this example, a reduction in absorption $\alpha$ would be noted and the phase controller 335 would reduce $\rho$ to a point represented by $P_z$ to determine if such a reduction would increase $\alpha$. In this example, a reduction would not increase $\alpha$ because $P_x$ is at a "peak" on the curve relating $\alpha$ to $\rho$ at the constant ratio $P_g$ to $P_o$ of approximately 1.25.

Although the present invention has been described with reference to preferred embodiments, workers skilled in the art will recognize that changes may be made in form and detail without departing from the spirit and scope of the invention.

What is claimed:

1. An aircraft engine noise absorption system having a resonator cavity for absorbing incident noise except for a residue noise signal having a predominant frequency, said system comprising:

an actuator providing an actuator acoustic signal;

a microphone mounted in said cavity for sensing said predominant frequency; and a controller for setting said actuator acoustic signal to said predominant frequency and varying one of a phase and an amplitude of said actuator acoustic signal to decrease said residue noise signal.

2. The noise absorption system of claim 1 wherein said actuator is acoustically coupled to a plurality of cavities.

3. The noise absorption system of claim 2 wherein said actuator further comprises an acoustic resonator.

4. The noise absorption system of claim 1 wherein said actuator further comprises an acoustic resonator acoustically coupled to said cavity.

5. The noise absorption system of claim 4 wherein said acoustic resonator comprises a thin sheet of metal.

6. The noise absorption system of claim 1 wherein said actuator comprises a piezoelectric transducer.

7. A noise absorption system for reducing aircraft engine noise, comprising:

a sound absorbing resonator cavity;

a sound wave generating actuator acoustically coupled to said cavity providing a secondary noise signal;

a microphone mounted in said cavity and acoustically coupled to said cavity; and a controller responsive to unabsorbed reflected noise sensed by said noise sensor for setting a frequency of said secondary noise signal approximately the same as an incident noise signal and varying at least one of an amplitude and a phase of the secondary signal to increase absorption of the incident noise signal by said cavity.

8. The noise absorption system of claim 7 wherein said sound absorbing resonator cavity comprises a plurality of contiguous honeycomb cells having a common acoustically reflective wall.

9. The noise absorption system of claim 8 wherein said actuator is acoustically coupled to more than one of said cells.

10. The noise absorption system of claim 9 wherein said actuator further comprises an acoustic resonator.

11. The noise absorption system of claim 7 wherein said actuator further comprises an acoustic resonator acoustically coupled to said cavity.

12. The noise absorption system of claim 11 wherein said acoustic resonator comprises a thin sheet of metal.

13. The noise absorption system of claim 7 wherein said actuator comprises a piezoelectric transducer.

14. A noise absorption system for use with a passive acoustic liner composed of a plurality of contiguous honeycomb cells, said system comprising:

a sound wave generating actuator acoustically coupled to one of said cells;

a microphone mounted in said cavity and acoustically coupled to said cell; and a controller coupled to said noise sensor and for providing an actuator control signal having a frequency approximately the same as an incident noise signal and varying at least one of an amplitude and a phase of the control signal to increase absorption of the incident noise signal by said cell.

15. The noise absorption system of claim 14 wherein said actuator is acoustically coupled to more than one of said cells.

16. The noise absorption system of claim 15 wherein said actuator further comprises an acoustic resonator.

17. The noise absorption system of claim 14 wherein said actuator further comprises an acoustic resonator acoustically coupled to said cells.

18. The noise absorption system of claim 17 wherein said acoustic resonator comprises a thin sheet of metal.

19. The noise absorption system of claim 14 wherein said actuator comprises a piezoelectric transducer.

20. The noise absorption system of claim 11 wherein said control means provides a control signal that optimizes absorption of the incident noise signal by said cavity.

21. A method of absorbing aircraft engine noise comprising the steps of:

acoustically coupling a sound wave generating actuator to a sound absorbing resonator cavity;

mounting a microphone in said cavity and acoustically coupling said microphone to the cavity to produce an output signal responsive to an incident noise signal;

analyzing the sensor output signal to determine a frequency and at least one of an amplitude and a phase of the incident noise signal;

generating a noise absorbing signal coupled to the actuator having a frequency approximately the same as the incident noise signal and varying at least one of an amplitude and a phase of the noise absorbing signal to increase absorption of the incident noise signal by said cavity.

22. The method of claim 21 wherein said sound absorbing resonator cavity comprises a plurality of contiguous honeycomb cells having a common acoustically reflective wall.

23. The method of claim 22 wherein said actuator is acoustically coupled to more than one of said cells.

24. The method of claim 23 wherein said actuator further comprises an acoustic resonator.

25. The method of claim 21 wherein said actuator comprises a piezoelectric transducer.

26. The method of claim 21 wherein said generating step further comprises varying at least one of an amplitude and a phase of the noise absorbing signal to optimize absorption of the incident noise signal by said cavity.

* * * * *